United States Patent [19]

Hallmark

[11] 4,339,948

[45] Jul. 20, 1982

[54] WELL FORMATION TEST-TREAT-TEST APPARATUS AND METHOD

[75] Inventor: Bobby J. Hallmark, Fort Worth, Tex.

[73] Assignee: Gearhart Industries, Inc., Fort Worth, Tex.

[21] Appl. No.: 143,779

[22] Filed: Apr. 25, 1980

[51] Int. Cl.[3] ..... E21B 49/00

[52] U.S. Cl. ..... 73/155; 166/264

[58] Field of Search ..... 73/155; 166/250, 264, 166/279

[56] References Cited

U.S. PATENT DOCUMENTS 3,289,474 12/1966 Smith ..... 73/155

3,577,781 5/1971 Lebourg et al. ..... 166/264 X

*Primary Examiner*—Jerry W. Myracle

*Attorney, Agent, or Firm*—Hubbard, Thurman, Turner, Tucker & Glaser

[57] ABSTRACT

Discloses apparatus and method for testing, then treating, then testing the same sealed off region of earth formation within a well bore. Employs a sealing pad arrangement carried by the well tool to seal the test region to permit flow of formation fluid from the region. A fluid sample taking arrangement in the tool is adapted to receive a fluid sample through the sealing pad from the test region and a pressure detector is connected to sense and indicate the build up of pressure from the fluid sample. A treating mechanism in the tool injects a treating fluid into said sealed test region of earth formation. A second fluid sample is taken through the sealing pad while the build up of pressure from the second fluid sample is indicated.

10 Claims, 3 Drawing Figures

WELL FORMATION TEST-TREAT-TEST APPARATUS AND METHOD

The present invention relates to tools for testing and treating earth formations in boreholes and more particularly for making formation pressure measurements, acquiring information concerning formation permeability and productivity, treating a particular formation, and retrieving samples of formation fluids from the treated formation.

DESCRIPTION OF THE PRIOR ART

The commonly assigned and copending application Ser. No. 908,579, filed May 22, 1978 now U.S. Pat. No. 4,210,018, and herein identified as the "RFT" application (issue fee paid), is pertinent and hereby incorporated by reference. Exemplary prior art formation testing tools shown in U.S. Pat. Nos. 3,813,936, 3,780,575, 3,782,191, 3,811,321, 3,858,445, 3,859,850, 3,864,970, 3,924,463, 3,959,851, 3,934,468, and 3,952,558 are abstracted in the "RFT" application.

Also, this invention as described herein is adapted for use in the formation testing tool disclosed in my copending and commonly assigned application Ser. No. 042,431 now U.S. Pat. No. 4,270,385, filed May 25, 1979, which is hereby incorporated by reference.

SUMMARY OF THE INVENTION

The present invention is used with apparatus for achieving formation "shut-in" pressure measurements and for obtaining indications of formation permeability and potential production, and for obtaining formation fluid samples. Such apparatus provides a formation fluid mini-sample chamber having variable volume, and fluid passage means for communicating between the mini-sample chamber and the formation at the seal pad location.

An operator can control the volume of the mini-sample chamber. Signals transmitted to aboveground equipment are a measure of fluid pressure within the mini-sample chamber. Further signals transmitted to the aboveground equipment are a measure of the volume of the mini-sample chamber.

The transmitted signals give the operator an indication of the producing potential of the earth formation being tested. As desired by the operator, the apparatus can be actuated to inject a treating fluid, such as acid, into the formation being tested, give the injected acid some time to react with such formation, then repeat the sampling procedure. In the case of a tight limestone formation, or a formation partially plugged with drilling mud, the treating fluid reaction serves to increase the flow permeability of the formation.

DESCRIPTION OF THE PREFERRED EMBODIMENT

Figure 1:
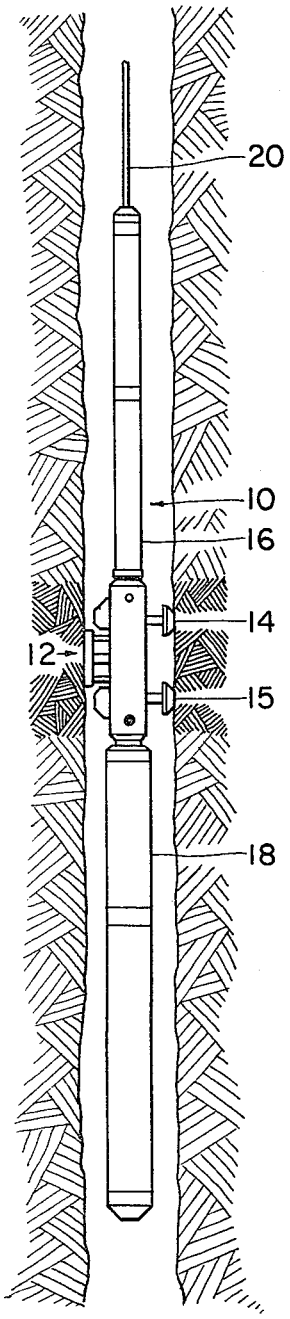
FIG. 1 is a schematic diagram showing the tool of the present invention suspended in a borehole.

In FIG. 1 there is shown a tool 10 of the present invention suspended in a borehole at the location of a formation to be tested, with a seal pad section 12 including backup pads 14, 15 in the set condition. The tool 10 is made up to three primary sections which may be termed the seal pad section 12, the upper tool section 16, and the lower tool section 18.

The cable 20 and winch means by which the tool 10 is suspended and traversed along the borehole, as well as the aboveground equipment, are conventional and consequently need not be described.

Apparatus (not shown) contained in upper section 16 for generating and controlling hydraulic pressure to extend and set seal pad means and backup pad means and to release same, may be referred to as the hydraulic power assembly. The hydraulic power assembly comprises an electrically driven hydraulic piston and cylinder assembly.

Apparatus for conducting various formation tests and for providing and controlling flow valve means may be referred to for convenience as the mini-sample apparatus. The mini-sample apparatus (not shown) is contained within the portion of the upper tool section 16 and comprises an electrically driven mini-sample cylinder piston assembly.

The pad block section 12 carries a sealing pad assembly 22, upper and lower backup pad assemblies 24, 25, and an equalizer valve assembly 26.

The sealing pad assembly 22 comprises a sealing pad 28, sealing pad retainer 30, sealing pad plate 32, upper and lower sealing pad guide rods 34, 36, sealing pad piston 38, sealing pad piston plug 40, and sealing pad cylinder 42. The sealing pad 28 is made of a resilient material such as rubber, which typically may be 60–90 durometer nitrile rubber, and has a generally rectangular shape, with some curvature in transverse section so as to generally conform to the borehole wall curvature.

The sealing pad plate 32 is a metal plate that covers a large portion of the inner surface of the sealing pad.

The upper and lower sealing pad guide rods 34, 35, are secured to the sealing pad plate 32 adjacent its respective upper and lower edges and are reciprocable in respective mating bores. The sealing pad retainer 30 is generally cylindrical having a central bore, a flanged outer end, a cylindrical exterior portion matingly received by a sealing pad central bore, and an exterior threaded portion at its inner end which engages internal threads at the outer end of the sealing pad piston 38.

When the sealing pad retainer 30 is in place, the sealing pad 28 is clamped between the retainer flanged outer end and the sealing pad plate, and the sealing pad plate is clamped between the sealing pad inner surface and the outer end face of the sealing pad piston 38. Thus, the sealing pad and sealing pad plate 32 are securely fixed relative to the sealing pad piston 38.

The sealing pad piston 38 has a first exterior cylindrical surface that extends over about half its length from the center portion outwardly toward the sealing pad 28 and a second cylindrical exterior surface 44 of smaller diameter extending from the center portion inwardly to the inner end.

The sealing pad piston 38 has a cylindrical central bore 46 extending between the internal threads at the outer end portion and internal threads at the inner end portion, which cylindrical central bore 46 merges with and has the same diameter as the cylindrical bore at the inner end of the sealing pad retainer 30.

The sampler pad block 12 has a central transverse bore having a first cylindrical portion matingly and sealingly receiving the first exterior cylindrical surface of the sealing pad piston 38 and merging with a second cylindrical portion of increased diameter for providing a fluid flow passage to and around the sealing pad piston 38.

The sealing pad piston plug 40 has a cylindrical exterior portion that matingly and sealingly engages a first cylindrical interior surface of the sealing pad cylinder and merges with a threaded cylindrical portion of reduced diameter which engages the threads at the inner end portion of the sealing pad piston 38.

The pad guards 24, 25 are sealingly fixed to the pad block exterior surface by bolts and serves to protect the sealing pad 28.

The lower backup pad assembly 15 is similar to the upper backup pad assembly 14.

The equalizer valve assembly 26 comprises a piston 48, a seal ring 50, a retainer plug 52, and a bias spring 54. The sampler pad block 12 is provided a bore 56 for receiving the equalizer valve assembly 26. The piston 48 matingly and sealingly engages adjacent its inner end a portion 58 of the pad block bore 56 with an o-ring seal 60, and adjacent its outer end into a central bore of the seal ring 50. The inner end of the piston 48 is exposed to a hydraulic fluid flow passage, while the outer end is exposed to well bore fluid.

The retainer plug 52 threadedly engages the outer end portion of the pad block bore 56 to hold the seal ring in place within a portion of the pad block bore 56.

The bias spring 52 bears at one end on the seal ring and at the other end on a shoulder on the piston 48, so as to urge the piston inwardly for a purpose to be hereinafter explained.

The lower tool section 18 includes sample chamber means of a conventional design and consequently will not be described herein.

The formation treating apparatus 100 of the present invention is housed within the central bore 46 of the sealing pad piston 38, retained at its outer end by pad retainer 30, and retained at its inner end the pad piston plug 40.

The treating apparatus 100 comprises a fluid container barrel 102 mounted for reciprocation within the central bore 46 and urged toward pad retainer 30 by means of a spring 104 disposed between the inner end of barrel 102 and the bottom of a borehole defined in the piston plug 40.

The outer end of barrel 102 defines an internal valve seat 106 receiving a valve ball 108 urged into sealing relation within seat 106 by a ball spring 110. Spring 110 is mounted in compressed relation against ball 108 by means of a retainer nose 112 threadedly connected into the outer end of the barrel 102. As provided, the ball 108 and seat 106 serve as a check valve permitting fluid flow only from within the barrel 102 to the immediate region at retainer 30.

A fluid ejection piston 114 is slidably mounted within the barrel 102 and a fluid tight o-ring seal 116 is provided intermediate the internal wall of barrel 102 and the external diameter of piston 114. The piston 114 may be retained within the barrel 102 by means of a retainer snap ring 118 as shown.

It is to be noted that the outer end of barrel 102 defines a valve face 122 which engages a valve seat 124 defined in the interior of pad retainer 30. The barrel spring 104 serves to urge the barrel 102 and its face 122 into sealing relation with seat 124. As provided, fluid from a region of formation sealed by pad 28 may flow past valve face 122 into bore 46 and on through passage 37 but may not flow in the reverse direction.

In the operation of this invention, the cavity defined within the barrel 102 and between the valve seat 106 and the face of piston 114 is first filled with a treating fluid 120.

The composition of treating fluid 120 may be varied, depending on the nature of the earth formation to be treated and the nature of the drilling mud particulates which could be plugging the interstices of the earth formations. Acetic acid has been used. Hydrochloric acid, or a mixture comprising hydrochloric acid and acetic acid, may be used. This mixture, sometimes with other additives, may be called a mud clean out agent.

When the tool 10 has reached the test site and the sampler pad section 12 has been extended and set in sealing engagement with the formation and the volume of the mini-sample chamber has been opened up, then the pressure force on the inner face of the piston 38 will be less than that on the outer face, so that the piston shaft will be continually urged into contact with the formation.

Figure 2:
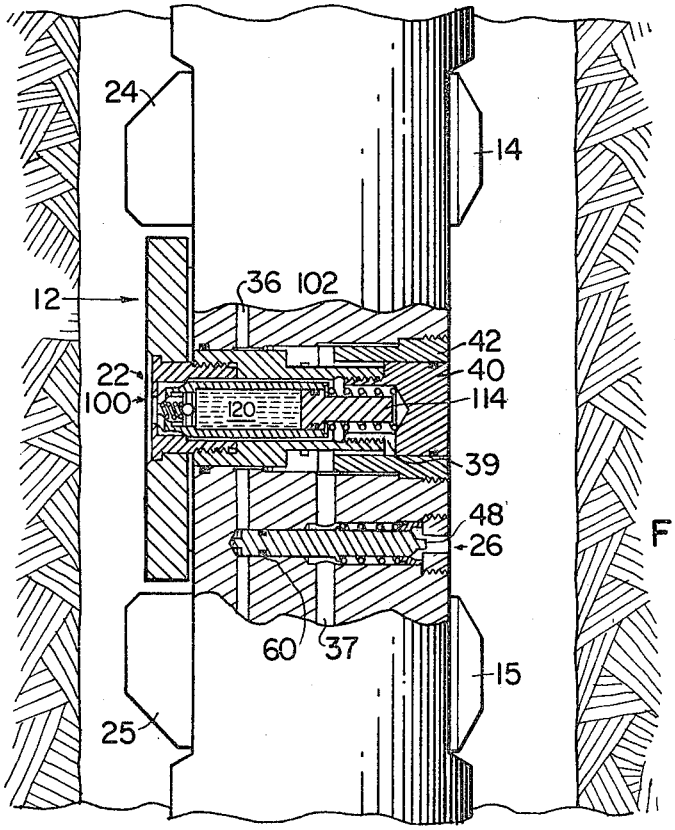
FIG. 2 is a schematic longitudinal section view of a portion of the tool of FIG. 1 which shows the fluid treating mechanism of the present invention in the retracted position as when the tool is being lowered into and removed from a well bore.

As the tool 10 is run into the borehole, all parts are in the positions shown by FIG. 2.

Figure 3:
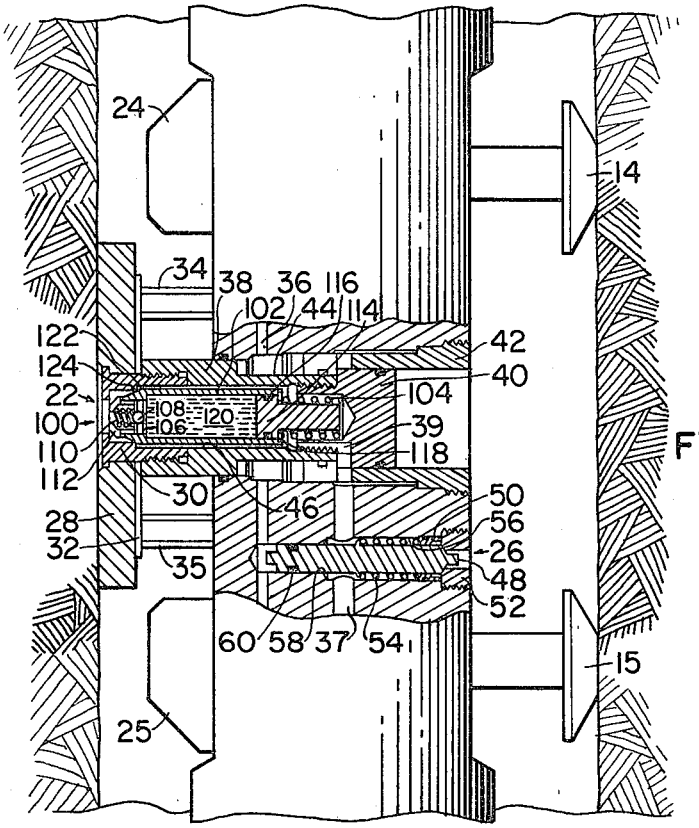
FIG. 3 is the portion of the tool shown in FIG. 2 with the fluid treating mechanism in position to convey its contained fluid into an adjacent earth formation.

When the tool 10 is stopped at the depth of the earth formation to be tested, the operator energizes the setting motor to force hydraulic fluid through passage 36 to the interior of the sealing pad piston 38 and the interiors of the upper and lower backup pad assemblies 14, 15, thus causing the sealing pad 28 and the backup pads 14, 15 to be extended into contact with wall of the well bore as shown in FIG. 3.

When the hydraulic fluid pressure reaches a designated value, which may be about 1500 p.s.i. above the well bore pressure, then the sealing pad 28 is considered to be set, thus isolating the formation at the sealing pad location.

Next, the operator energizes the mini-sample motor to cause the volume of the mini-sample chamber to begin to increase.

The mini-sample chamber communicates with the formation being tested at the seal pad location via passage means which can be traced from the mini-sample chamber through a passage 37 in the pad block 12 through a further passage 39 in the piston plug 40 to the interior of the sealing pad piston bore 46 which is exposed to the region of earth formation at the sealing pad location.

It should be observed that the operator opens the mini-sample chamber only sufficiently to cause the pressure therein to drop to a point considered to be below the likely formation shut-in pressure, and then de-energizes the mini-sample motor and waits for the mini-sample chamber pressure to build up and stabilize.

If the formation being tested has a low permeability, only a small amount (perhaps only a few c.c.) of formation fluid need be drawn into the mini-sample chamber to achieve formation "shut-in" pressure. If it were necessary to wait for a large test sample chamber to fill before formation "shut-in" pressure is achieved, this could take a long time in the case of low permeability formations.

When the operator determines that the formation being tested manifests a low permeability, yet when other information, as from electrical well logs, indicates that the formation should have a better show, then the treating apparatus of the present invention can be brought into use while the tool 10 remains in the testing position as shown in FIG. 1 so as to treat the identical formation just tested.

To treat the formation, the operator energizes the mini-sampler motor in reverse direction to urge fluids back up through passage 37 and passage 39 into the central piston bore 46 and toward the earth formation sealed off by the sealing pad 28. Fluid pressure is built up in the bore 46, due to the check valve action of valve face 122 against valve seat 124 responsive to urging of spring 104. Such fluid pressure is exerted against the inner side of piston 114 and thereby against the treating fluid 120 contained within the barrel 102. The treating fluid 120 is thereby expelled past the valve ball 108 into the earth formation. The pressure build up in the mini-sample chamber will indicate to the operator that the piston 114 has moved as far as possible in ejecting the fluid 120.

Then operator then waits a few minutes to allow the treating fluid 120 to fully react within the earth formation, then repeats the testing and sampling procedure.

The treating fluid may, or may not, be effective in its reaction within the earth formation to increase the flow permeability of the formation. If the earth formation was plugged near the well bore wall only and is cleaned by the treating fluid, the subsequent test will be better than the initial test. If the formation is naturally tight or plugged back further than can be treated by the available amount of the treating fluid 120, then the subsequent test will likely be not better than the first test.

However, in either event, the present invention has provided a second test of the respective region of earth formation which could not otherwise have been obtained.

I claim:

1. In the method for testing, then treating, then testing the same sealed off region of a well earth formation, the steps comprising:

(a) isolating a wall region of the earth formation to be tested;

(b) opening a fluid sample chamber to drain a fluid sample from the isolated region of earth formation while sensing the pressure build up of the fluids drawn into said chamber;

(c) expelling a formation treating fluid from a treating fluid chamber into said isolated region of earth formation; and (d) again opening a sample chamber to draw a fluid sample from said isolated region of earth formation while sensing said pressure build up.

2. The method of claim 1 wherein said treating fluid is an acid.

3. The apparatus of claim 2 wherein said acid is of a kind adapted to clean out the interstices of the earth formation within said regions.

4. The method of claim 1 wherein a designated time period is allowed to elapse between the step of expelling treating fluid into said isolated region of earth formation and again drawing a fluid sample therefrom.

5. Apparatus for testing, then treating, then testing the same sealed off region of earth formation within a well bore from an elongated well tool comprising:

(a) sealing means carried by said well tool for sealing said region to permit flow of formation fluid from said region;

(b) a fluid sample chamber means in said tool adapted to receive a fluid sample through said sealing means from said region;

(c) sensing means connected to sense and indicate the build up of pressure from said fluid sample;

(d) treating means for injecting a treating fluid into said sealed off region of earth formation; and (e) means to receive a second fluid sample through said sealing means while indicating the build up of pressure from said second fluid sample.

6. The apparatus of claim 5 wherein said treating means comprises a fluid container adapted to eject a designated amount of treating fluid responsive to the force of fluid pressure exerted across said container.

7. The apparatus of claim 6 wherein said fluid container comprises a cylindrical barrel, valve means provided with said barrel for releasing fluid from said barrel through said sealing means, and piston means within said barrel and responsive to fluid pressure to ejecting fluid from said barrel through said valve means.

8. The apparatus of claim 7 wherein said container contains an acid fluid to be ejected.

9. The apparatus of claim 7 wherein said container provides one seat of a check valve means and said sealing means provides a second opposing seat for said check valve means with said check valve means being operable to permit fluid flow only in the direction of from said region into said tool.

10. The apparatus of claim 5 wherein said treating means contains a treating fluid comprising an acid.

* * * * *